US006659723B2

(12) United States Patent
Bankstahl

(10) Patent No.: US 6,659,723 B2
(45) Date of Patent: Dec. 9, 2003

(54) FAN FOR AN ENGINE DRIVEN GENERATOR

(75) Inventor: Herbert A. Bankstahl, Appleton, WI (US)

(73) Assignee: Illinois Tool Works Inc., Glenview, IL (US)

( * ) Notice: Subject to any disclaimer, the term of this patent is extended or adjusted under 35 U.S.C. 154(b) by 111 days.

(21) Appl. No.: 09/683,097

(22) Filed: Nov. 16, 2001

(65) Prior Publication Data

US 2003/0095867 A1 May 22, 2003

(51) Int. Cl.[7] ..... F04D 29/30

(52) U.S. Cl. ..... 416/185; 416/204 R; 416/235; 416/223 B; 415/175

(58) Field of Search ..... 416/132 R, 132 A, 416/175, 183, 185, 203, 204 R, 223 B, 235, 223 R, 244 R; 415/175; 29/889.4

(56) References Cited

U.S. PATENT DOCUMENTS 1,011,259 A * 12/1911 Smith et al. ..... 416/185
3,521,973 A * 7/1970 Schouw ..... 416/185
4,676,722 A * 6/1987 Marchal et al. ..... 416/188

* cited by examiner

*Primary Examiner*—Ninh H. Nguyen
(74) *Attorney, Agent, or Firm*—Ziolowski Patent Solutions Group, LLC

(57) ABSTRACT

A fan blade configuration for use with a fan in an engine driven generator is disclosed. The invention includes a plurality of fan blade segments fixed to a hub at one end of a rotary shaft. Upon transmission of a driving force to the rotary shaft, the fan blades and hub are rotated to cool the engine driven generator. The fan blades are arranged to extend away from the rotating shaft, and each have a plurality of fins and protrusions molded on opposite sides of the fan blade segments. The fan blade configuration also includes a flexible plate to bias the fan blades against the hub and stabilize the fan blades during rotation.

26 Claims, 13 Drawing Sheets

FAN FOR AN ENGINE DRIVEN GENERATOR

BACKGROUND OF INVENTION

The present invention relates generally to generator cooling, and more particularly, to an apparatus and method to stabilize a fan for cooling an engine driven generator.

Engine driven welding machines or welders generate considerable heat and noise during operation, which are undesired characteristics of the device. One source of heat generation in a welder is a generator which combines with other components to increase the temperature of the operating environment. Another undesirable byproduct of welder use is noise generation which occurs primarily due to the operation of a fan that cools the generator and an external engine that drives the generator. In a proper operating environment, the welder must have sufficient heat removed to keep the engine, generator, and other components at suitable operating temperatures. A failure to maintain the proper operating environment will result in the output of the welder becoming limited due to the rise in temperature, which is undesired.

Historically, noise emanates from the generator due to the rotation of the fan which operates to cool the generator. Prior art machines utilized different fans to produce airflows through the generator. Such fans were generally connected to a rotary shaft having a hub member at one end of the rotary shaft with a plurality of fan blades connected thereto. The fans were generally complete, unitary pieces with each of the fan blades and hub constructed from a metal, such as aluminum. Constructing the fan blades of a unitary metal material stabilized the fan during rotation and reduced vibrational noise. Some such prior art devices further include fins positioned on the fan blades that were spaced apart from one another and extend outwardly from the fan blades.

The prior cooling and noise reduction efforts for engine driven welding machine generators are not completely satisfactory. Constructing fan blades of metal materials such as aluminum and steel can be costly. Moreover, it is desirable to reduce noise generated by a welder to provide safer and user-friendlier operating conditions. Furthermore, excess noise due to vibration of the fan blades is also a concern. Rotation of the fan can result in increased noise levels at certain harmonic frequencies, which are a function of the size, shape, and materials that form the fan.

There is a need for an apparatus capable of reducing noise vibrations of a rotary fan during cooling of an engine driven welding machine generator in a more efficient manner than current fan configurations. It would therefore be desirable to have a more economical fan blade arrangement capable of preventing harmonic frequency vibrations from occurring in a fan.

BRIEF DESCRIPTION OF INVENTION

The present invention is directed to a system and method to cool an engine driven welding machine generator more economically and with reduced noise vibrations by stabilizing the fan blades about an annular lip of a hub rotated by a rotary shaft to overcome the aforementioned concerns.

The present invention includes a fan fixed to one end of a rotary shaft. Upon transmission of a driving force to the rotary shaft by a flywheel, the fan rotates to cool a generator, such as a generator of an engine driven welding machine.

The fan is constructed of at least one fan blade segment that extends away from the rotating shaft and have a plurality of fins on the fan segments. Nearest protrusions are generally separated by respective arc distances such that at least two of the arc distances of the fan are unequal. A flex plate is also included to secure the fan blades to a hub.

In accordance with an aspect of the present invention, a fan is disclosed and includes a fan blade assembly having an inner arcuate end. The fan further includes a hub having an inner annular lip and an outer annular lip, the outer annular lip adapted to receive the inner arcuate end of the fan blade assembly. The fan also has a flexible plate having an aperture therethrough to receive the inner annular lip therein, the plate attached to the hub and fan blade assembly and configured to provide flexation to the fan blade assembly.

In accordance with another aspect of the present invention, a system for cooling an engine driven welding machine generator includes a rotary shaft having a first end rotatably attached to a generator housing. The rotary shaft is rotated by transmission of a driving force applied thereto by a flywheel through a flex plate. The system has a hub fastened to a second end of the rotary shaft and at least two fan blade segments configured to engage an outer annular lip of the hub. The flex plate is affixed to the flywheel and has at least two fan blade segments mounted thereto. The plate also has an aperture to receive an inner annular protrusion of the hub therein.

In accordance with the process of the present invention, a method to stabilize a fan for cooling an engine driven welding machine generator has two steps. One step includes positioning a number of fins to at least one fan segment such that adjacent fins have unequal spacing therebetween. The other step includes connecting the at least one fan segment between a hub and a plate.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

Figure 1:
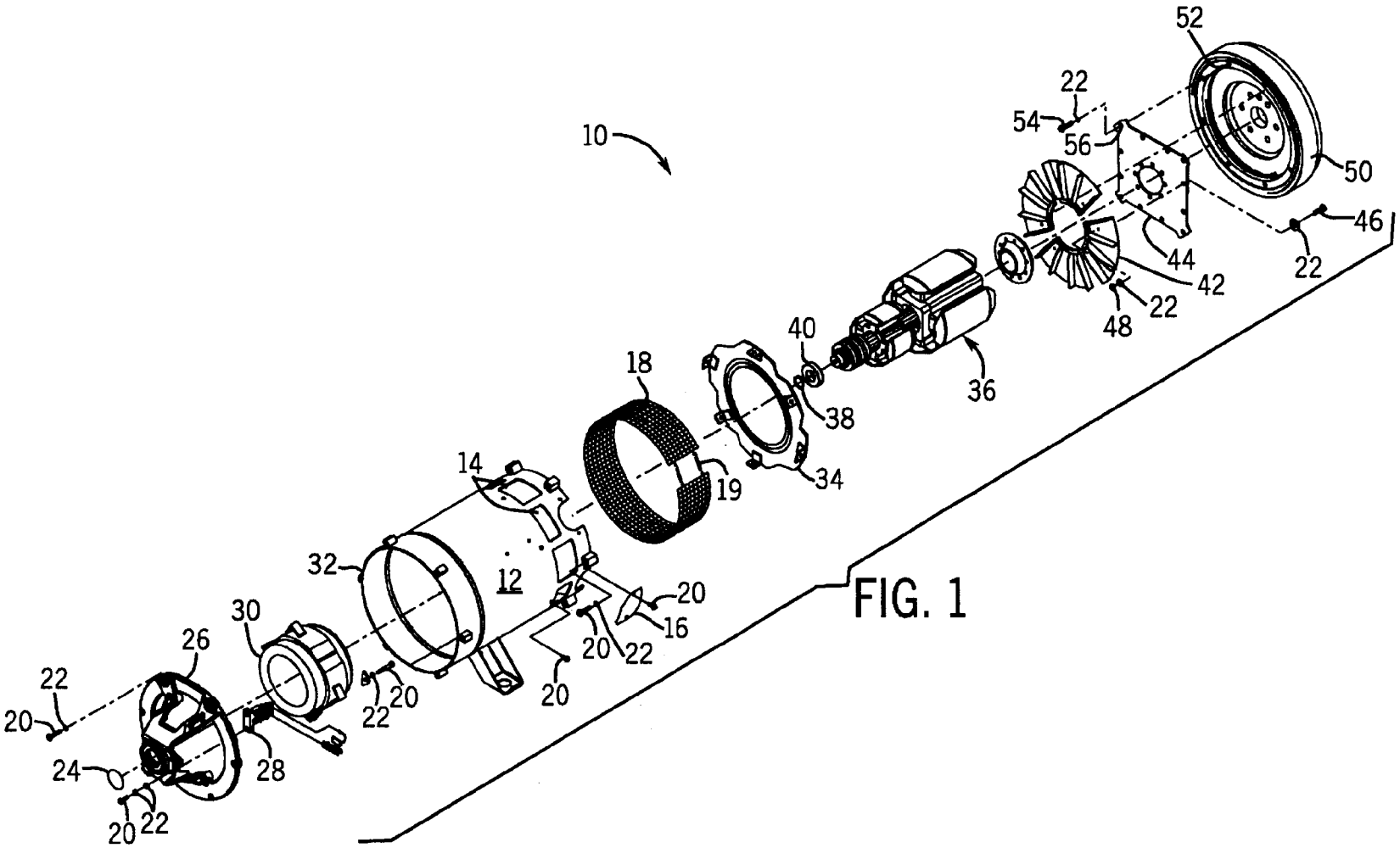
FIG. 1 is an exploded perspective view of an engine driven generator.

Referring to FIG. 1, an exploded view of an engine driven generator 10 is shown. The generator 10 has a housing 12 having a plurality of air vents 14 encircling the housing 12 and a starter hole cover 16. A wire mesh 18 having a pair of spring connectors 19 encloses the air vents 14 and prevents foreign objects from entering into the generator 10. The generator 10 also has external and internal components that are fixed in position by screws 20 and washers 22. Internal components include an o-ring 24, a support assembly 26 mounted to the housing 12, a brush holder assembly 28, a small stator 30, a large stator 32, and an air baffle 34. Other internal components include a rotor assembly 36 having a rotor ring 38, a rotor bearing 40, and a fan assembly for generator cooling 42. The fan assembly 42 has a flex plate or plate 44 that is fastened to the rotor 36 by fan blade screw 46, a pair of washers 22, and a fan blade nut 48. The rotor 36 is connected to a flywheel 50 which is further coupled to an engine (not shown). Threaded apertures 52 of the flywheel 50 receive four flex plate corner screws 54 that pass through four corner apertures 56 of the plate 44.

Figure 2:
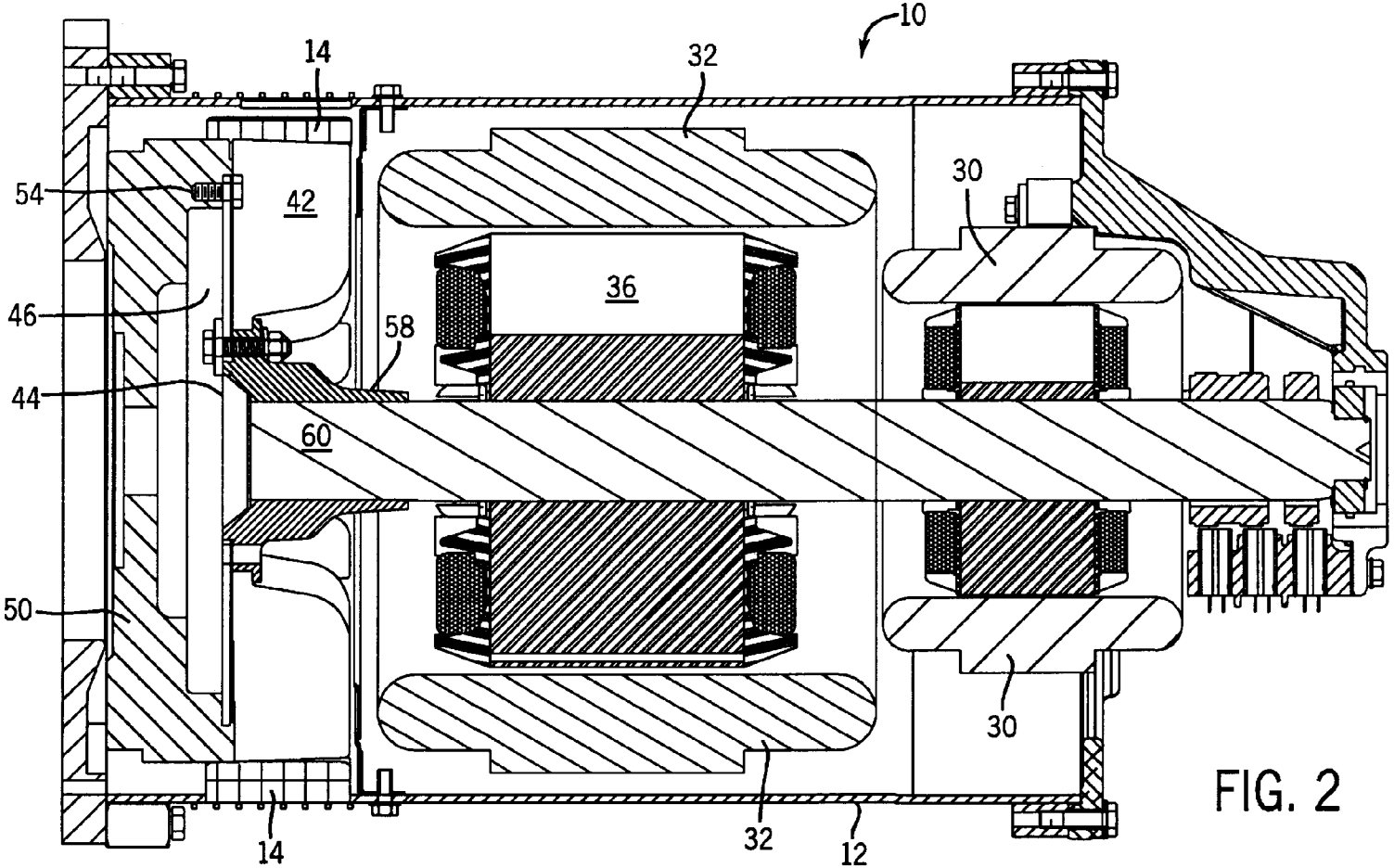
FIG. 2 is a cross-sectional view of the engine driven generator.

FIG. 2 provides a cross-sectional view of an assembled generator 10 of FIG. 1. Air vents 14 permit airflow through the interior of housing 12 during fan 42 operation to cool the generator's internal components, such as the small stator 30, large stator 32, and rotor 36. Flex plate corner screw 54 secures the plate 44 to the flywheel 50. In operation, the plate 44 is configured to rotate with the flywheel 50, which causes rotation of the fan 42. The fan 42 has a hub 58 press fit to a rotary shaft 60 that also rotate with the flywheel 50.

Figure 3:
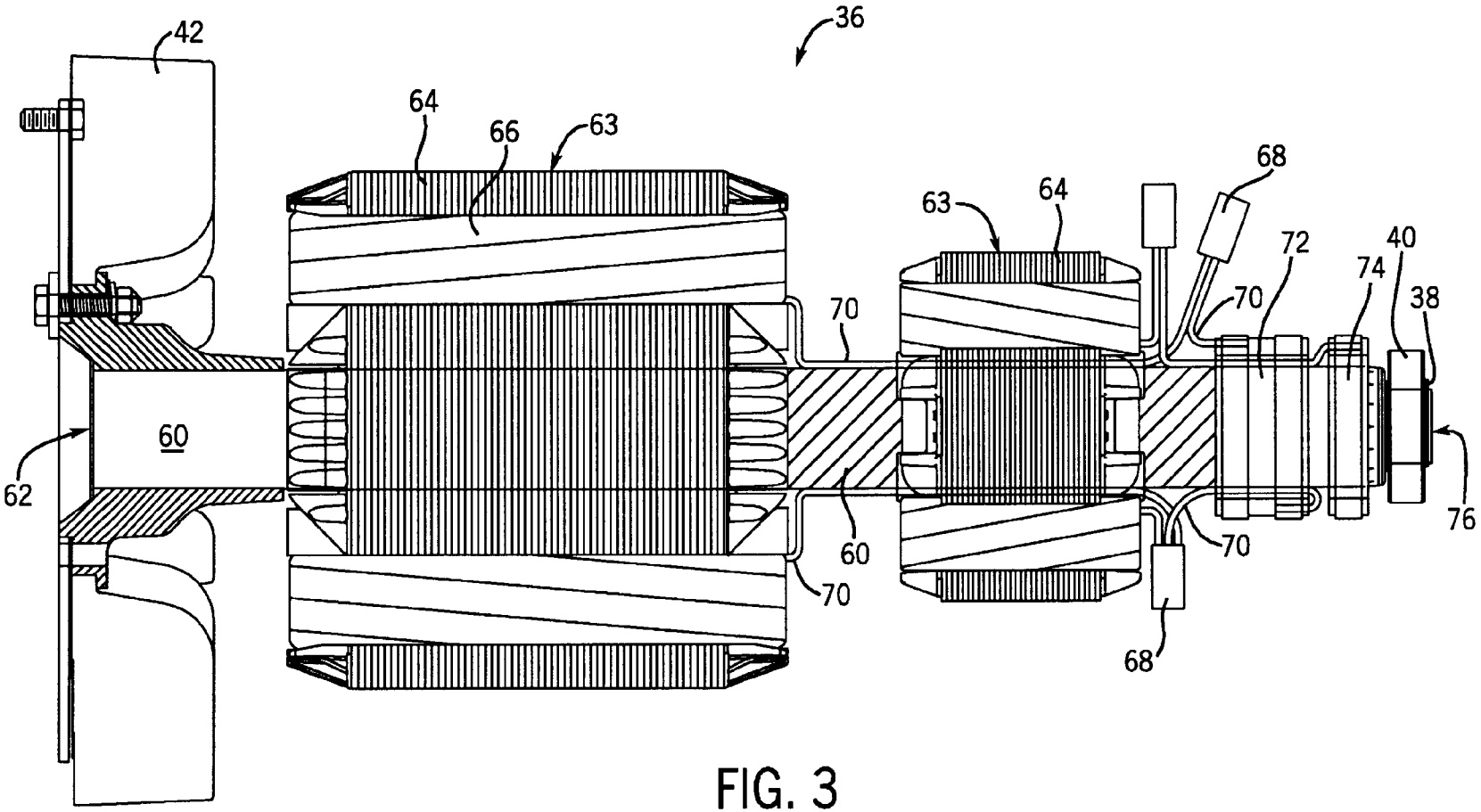
FIG. 3 is a cross-sectional view of the rotor assembly of FIG. 1.

Referring now to FIG. 3, a cross-sectional view of the rotor assembly 36 is shown. The rotor assembly 36 has a rotary shaft 60 having a first end in which fan 42 is mounted thereto. The rotor assembly 36 also includes standard components known to those skilled in the art, such as a pair of rotational field assemblies 63 having laminated steel plates 64 and copper metal windings 66. Other standard rotor components include wire connectors 68 connecting wires 70, a pair of slip rings 72, and a single slip ring 74. Additionally, adjacent a second end 76 of the rotary shaft 60 the rotor 36 has a rotor ring 38 and a rotor bearing 40 which accommodate rotation of the rotary shaft 60.

Figure 4:
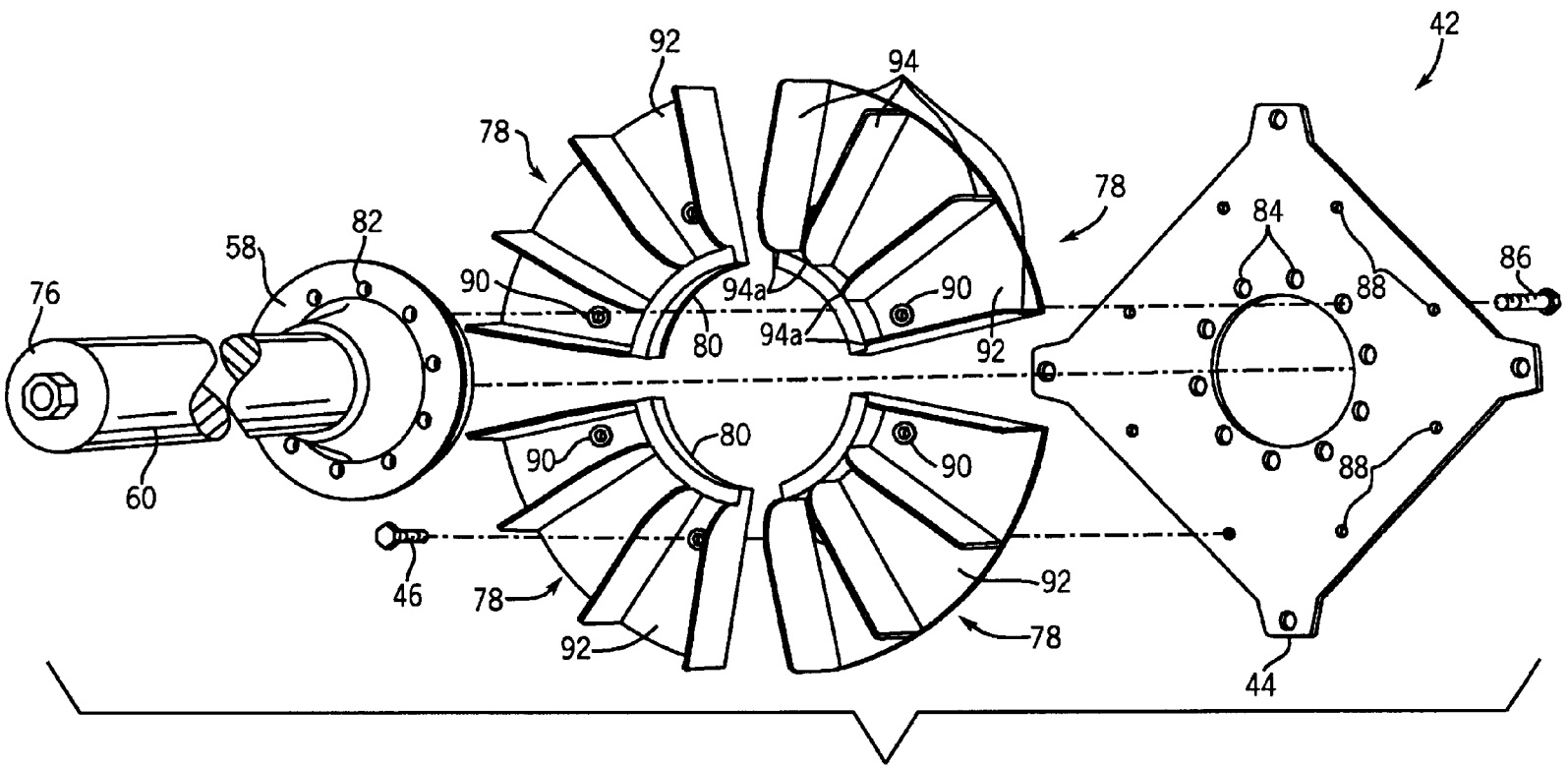
FIG. 4 is an exploded perspective view of the fan and hub assembly of FIGS. 1–3.

FIG. 4 shows an exploded view of the fan and hub assembly of FIG. 1 having the hub 58 connected to the rotary shaft 60 at one end. The second end 76 of the rotary shaft 60 is connected to the rotor bearing 40 to support the rotary shaft 60 when driving forces are applied to the rotary shaft 60. The fan assembly 42 includes a plurality of fan blade segments 78, each having a plurality of fins 94 attached to a base 92, attached to the flex plate 44. In a preferred embodiment, four fan blade segments 78 are concentrically located about the plate 44, and in one embodiment are equally spaced from one another. Each of the fan blade segments 78 has an arcuate inner end 80 that is positioned between the hub 58 and plate 44. A plurality of hub apertures 82 and inner plate apertures 84 each have a hub screw 86 passing therethrough to secure the hub 58 to the plate 44, and in a preferred embodiment are arranged such that ten screws are uniformly and circularly spaced around the hub 58. In an alternative embodiment, the hub 58 and plate 44 may have tapped apertures to permit fastening of the components to each other and the fan blade segments 78 without the need of a nut. Fan blade screws 46 pass through outer plate apertures 88 and fan blade apertures 90. The fan blade apertures 90 are located in the base 92 of the fan blade segment 78, and preferably number two per fan blade segment 78 to improve the fan assembly's stability. Fan blade screws 46 are preferably uniformly and symmetrically spaced about the hub 58 to fix each of the fan blade segments 78 concentrically about the hub 58.

Each of the fan blade segments 78 has a plurality of fins 94 for generating airflow during rotation of the fan assembly 42. The fins 94 have a tapered end concluding at a reduced inner diameter 94*a* to accommodate hub 58 and a squared-off end 94*b* (shown in FIG. 6) to maximize airflow. In a preferred embodiment, the fan assembly 42 includes four arcuately shaped fan blade segments 78 formed of an elastomer material that combine to form a circle. In another embodiment, the plate 44 is constructed of steel and fan blade segments 78 are comprised of nylon with each of the segments 78 having four fins 94 integrally molded to the fan blade base 92. In other embodiments, the fan blade segments 78 can be configured of more or less than four components, and the fan blade segments 78 can be constructed of plastic materials other than nylon.

Figure 5:
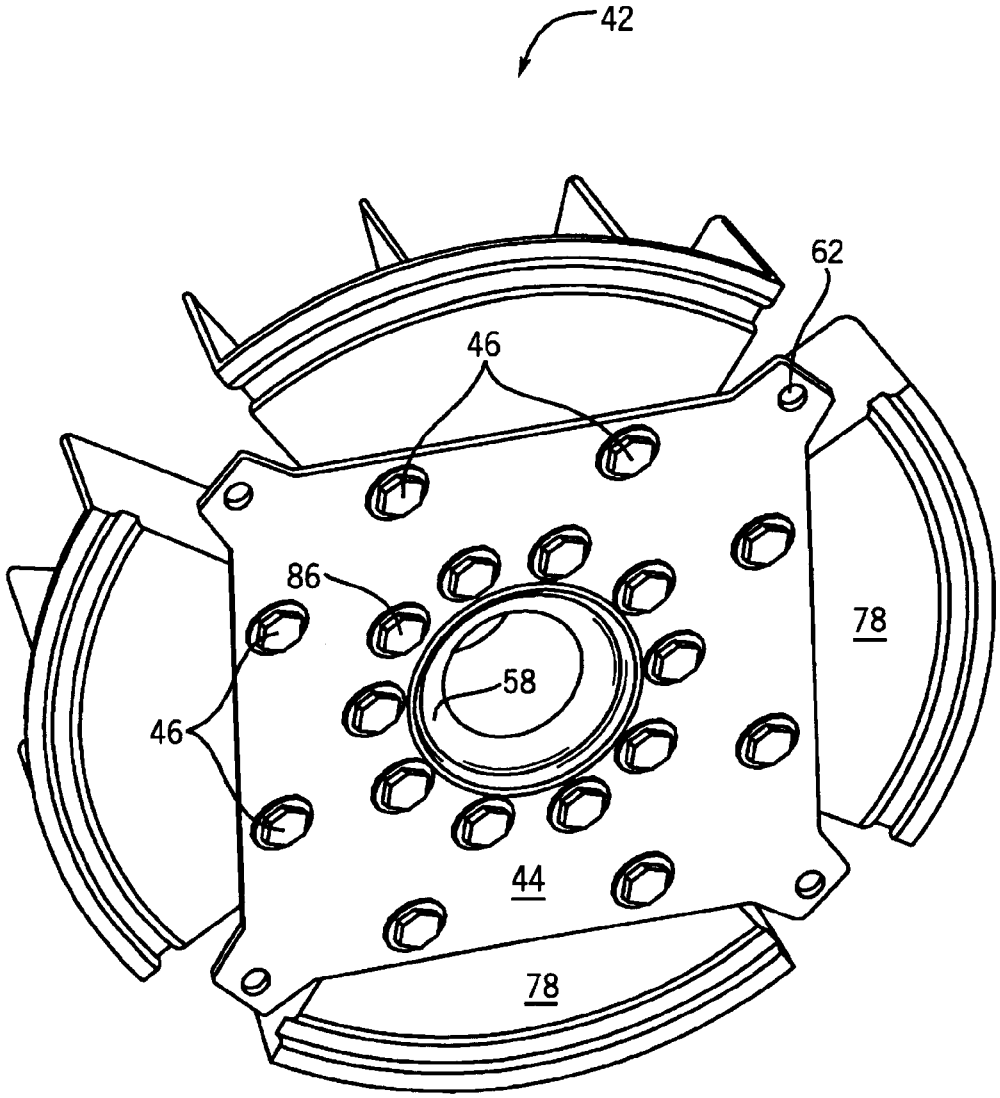
FIG. 5 is a rear perspective view of the fan assembly of FIG. 4 assembled.

FIG. 5 provides a rear view of an assembled fan assembly 42 showing the plate 44 mounted to the hub 58 and fan blade segments 78. Hub screws or bolts 86 connect the plate 44 to the hub 58. Similarly, fan blade screws or bolts 46 secure the fan blade segments 78 to the plate 44. The four corner apertures 56 are used to connect the plate 44 to the flywheel 50, which supports and drives the generator rotor 36. The assembly forms a lightweight and inexpensive circular fan assembly for efficiently cooling a generator with reduced external noise generation.

Figure 6:
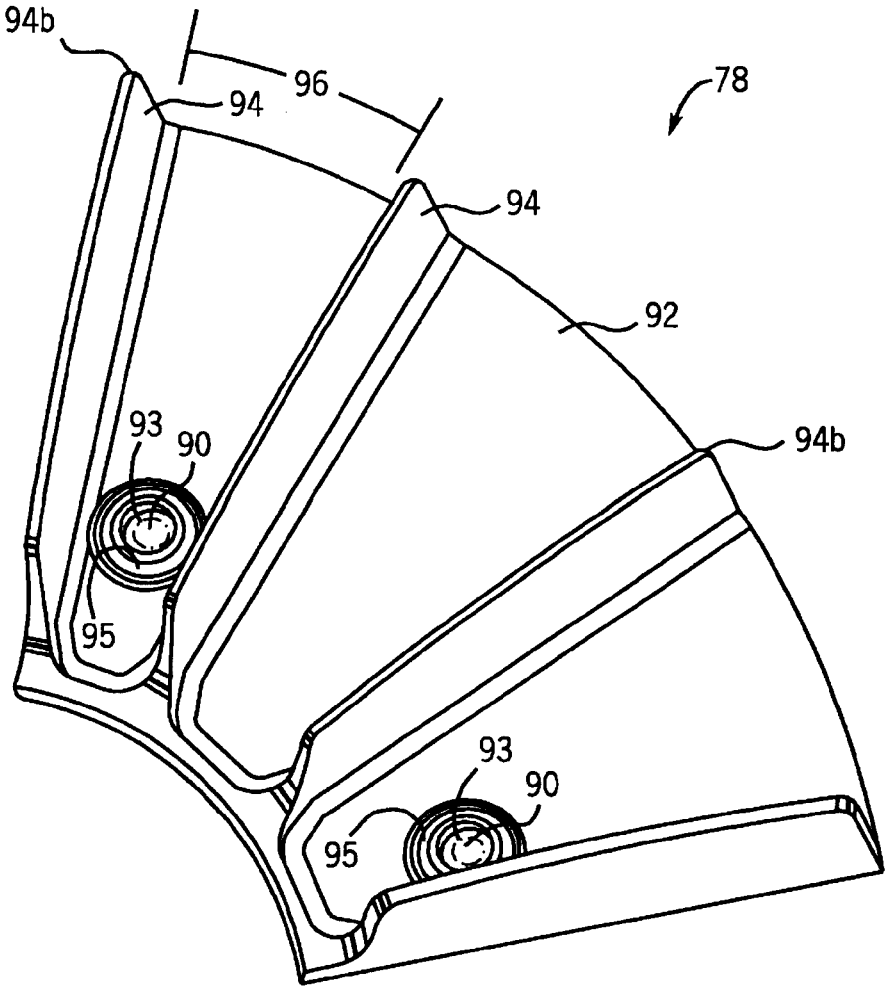
FIG. 6 is a perspective view of a portion of the fan assembly of FIG. 4.

Referring now to FIG. 6, one of the arcuately-shaped fan blade segments 78 of FIG. 4 is shown. The base 92 preferably has a pair of metal sleeves 93 having apertures 90 therethrough for fastening the fan blade segment 78 to the plate 44. Crush zones 95 are adjacent and generally parallel to the metal sleeves 93 and extend upwardly therefrom. The annular crush zones 95 are configured to compress during mounting of the plate 44 to the fan blade segment 78. Preferably, the crush zones 95 are formed of the same elastomer material as the fan blade segment 78. The crush zones 95 prevent looseness or movement between each of the fan segments 78 and the surfaces that the fan segments are mounted to at tolerance limit conditions. Metal sleeves 93 prevent damage to the base 92 of the fan blade segment 78 during fastening of the fan blade screw 46 to the fan blade nut 48. Contiguous fins 94 of the fan blade segment 78 have an arc distance 96 therebetween such that each of the arc distances between successive fins are unequal which has been found to reduce resonant noise vibrations. Such vibrations can occur at particular harmonic rotational frequencies of the fan. In particular, the harmonic frequencies will depend on the size, shape, and materials used to construct the fan.

In one embodiment, the fan blade segments 78 are formed identically and have unequal arc distances between successive fins 94. However, other fan blade fin arrangements are contemplated wherein at least two of the defined arc distances 96 between the fins 94 of one fan blade segment 78 or differing fan blades are unequal. Likewise, although the fan blade segment 78 preferably includes two fan blade apertures 90 for securing the segment 78 to the plate 44, single or multiple apertures can be utilized.

The inner arcuate end 80 of the fan blade segment 78 is designed to fit snuggly against the hub to provide stabilization between the hub and plate during operation. In one embodiment, the fins 94 are perpendicular to the base 92. Other fin arrangements having the fins 94 at acute or obtuse angles to the base 92 are contemplated within the present invention.

Figure 7:
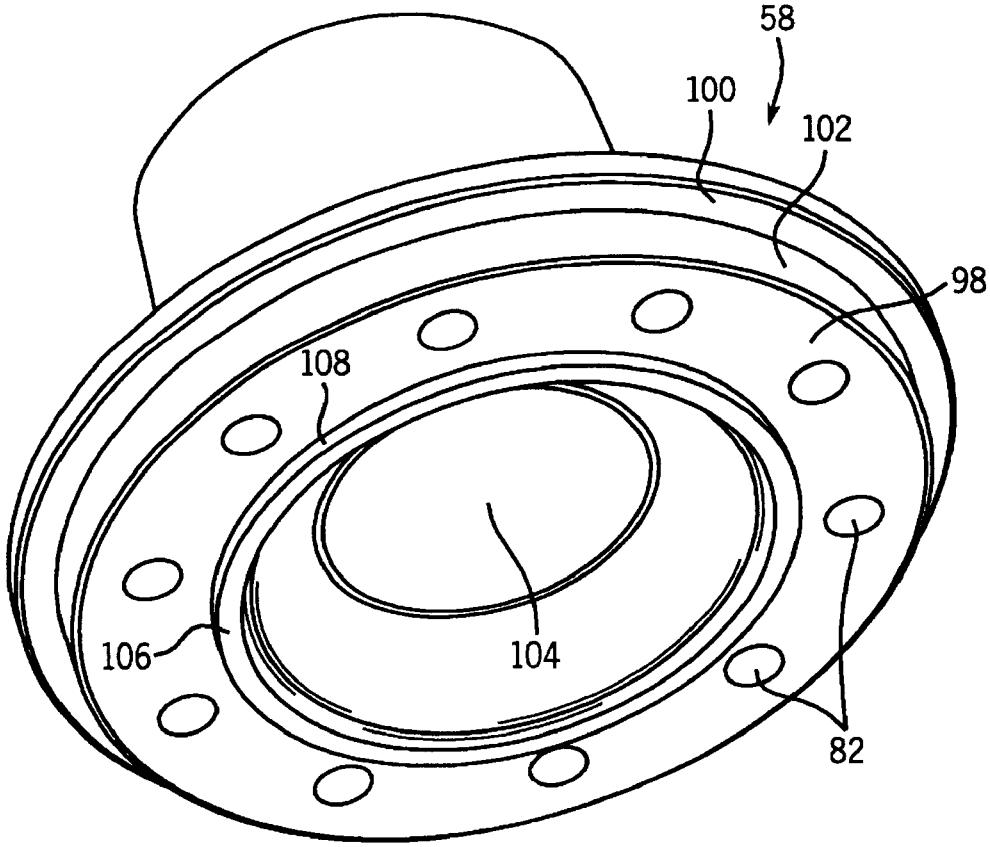
FIG. 7 is a perspective view of the hub of FIG. 4.

A perspective view of the hub 58 of FIG. 4 is shown in FIG. 7. The ten hub apertures 82 are concentrically located around a lower face 98 of the hub 58. The hub 58 has an outer annular protrusion or lip 100 for receiving the tapered ends 80 of the fan blade segments 78. Each of the fan blades engages a portion of a side wall 102 of the outer annular lip 100 such that the fins of the fan blade segments are essentially radially aligned from a center 104 of the hub 58. The hub 58 also has an inner annular protrusion or lip 106 configured to engage the plate 44 along a side surface 108. Inner annular lip 106 receives structural support from plate 44 during rotation of the fan assembly 42. Preferably, the inner annular lip 106 is circularly shaped, although other geometric shapes can be implemented if desired.

Figure 8:
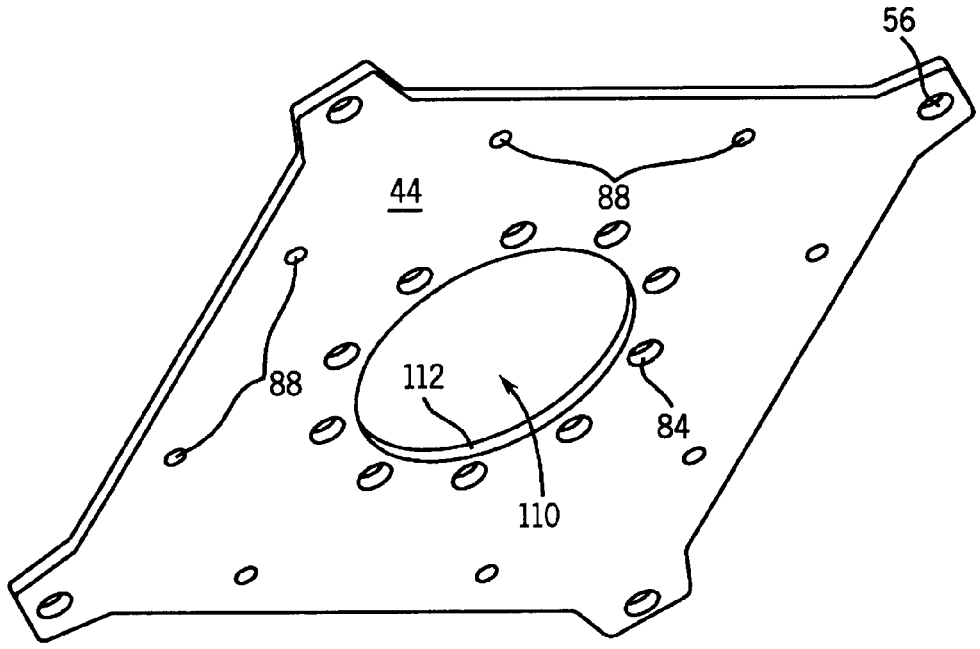
FIG. 8 is a perspective view of the plate of FIG. 4.

FIG. 8 is a perspective view of the plate 44 of FIG. 4. Apertures 56, 84, and 88 permit the connection of the hub, fan blades, and flywheel together as previously discussed. The flex plate 44 is configured to deform or compensate for non-perpendicular alignments between the rotary shaft 60 and an engine crankshaft (not shown) during fan rotation. A circular opening or aperture 110 defines an inner edge or surface 112 of the plate that abuts at least a portion of the side surface 108 of the inner annular lip 106 to stabilize the hub 58. Although a circular opening or aperture 110 is preferred, other geometrical shapes can be implemented with the present invention if the inner annular lip 106 of the hub 58 is geometrically contoured to match the shape of the aperture 110.

Figure 9:
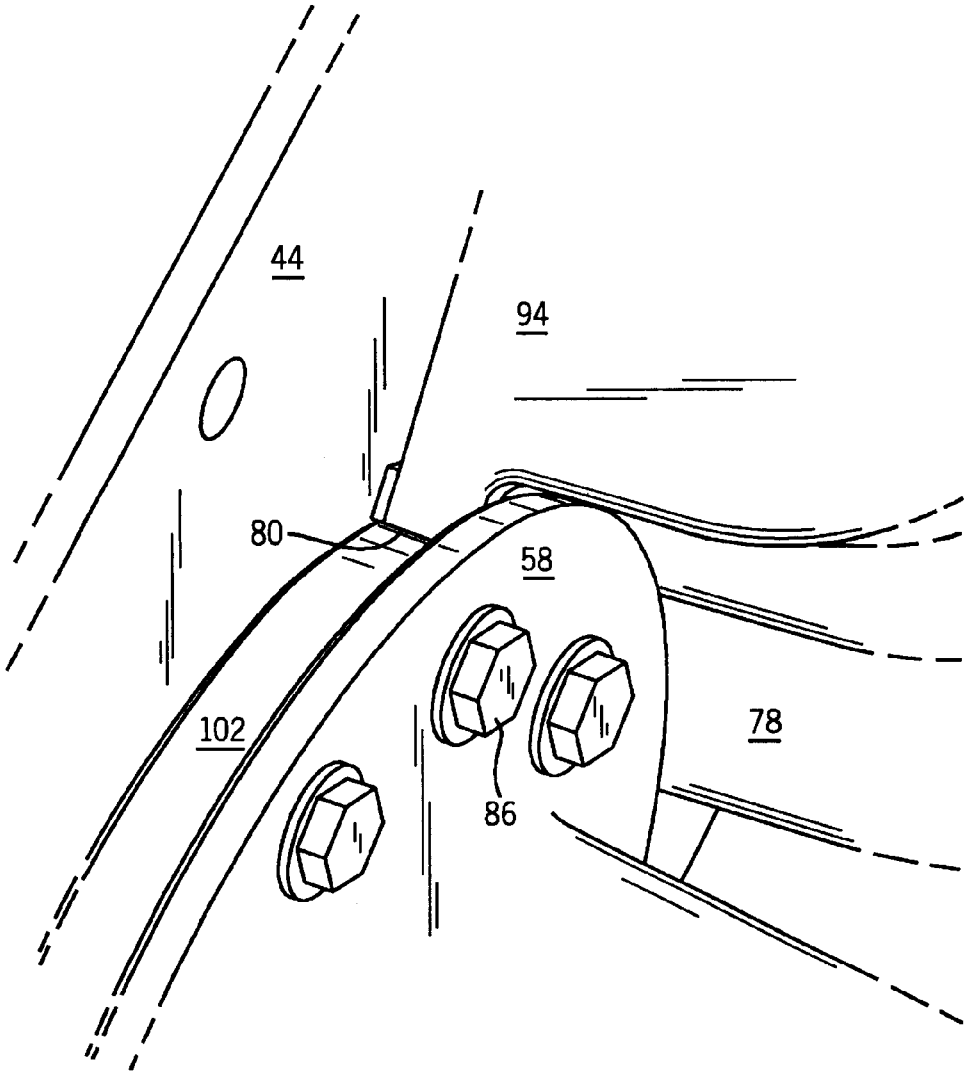
FIG. 9 is a detailed view of the fan assembly of FIG. 4 connected between the hub and plate.

Referring now to FIG. 9, a detailed view of the fan blade segment 78 of FIG. 4 is shown with the tapered end 80 of one fin 94 abutting the side wall 102 of the hub 58. The fan blade segment 78 has a contact pad 114 (shown in FIG. 10) adjacent to the inner arcuate end 80 of the fan blade segment 78 to limit the contact area between the segment 78 and the flex plate 44.

Figure 10:
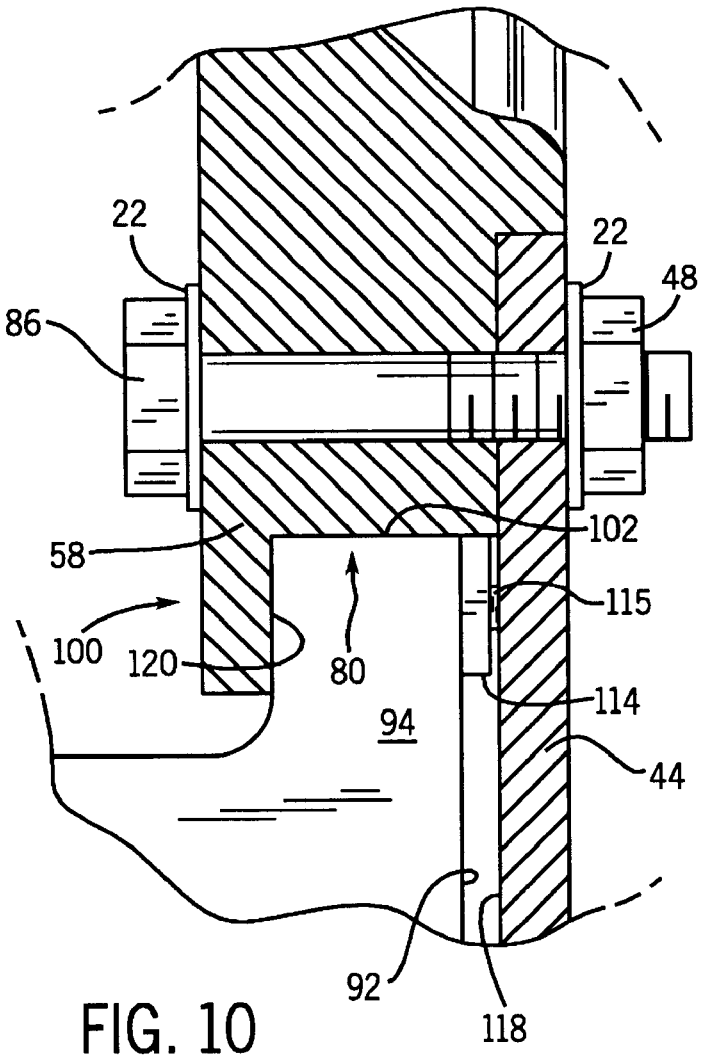
FIG. 10 is a partial cross-sectional view of the fan blade connection between the hub and plate.

FIG. 10 is a partial cross-sectional view of the fan blade connection between the plate 44 and hub 58. A crush zone 115 compresses during fastening of the hub screw 86 which causes the base 92 of the fan blade segment 78 to contact an upper surface 118 of the plate 44 to stabilize the fan blade. The tapered end 80 of the fan blade segment 78 fits snugly against an underside 120 of the outer rim 100 and side wall 102 of the hub 58 to further stabilize the fan and avoid looseness of the fan blade segments 78.

Figure 11:
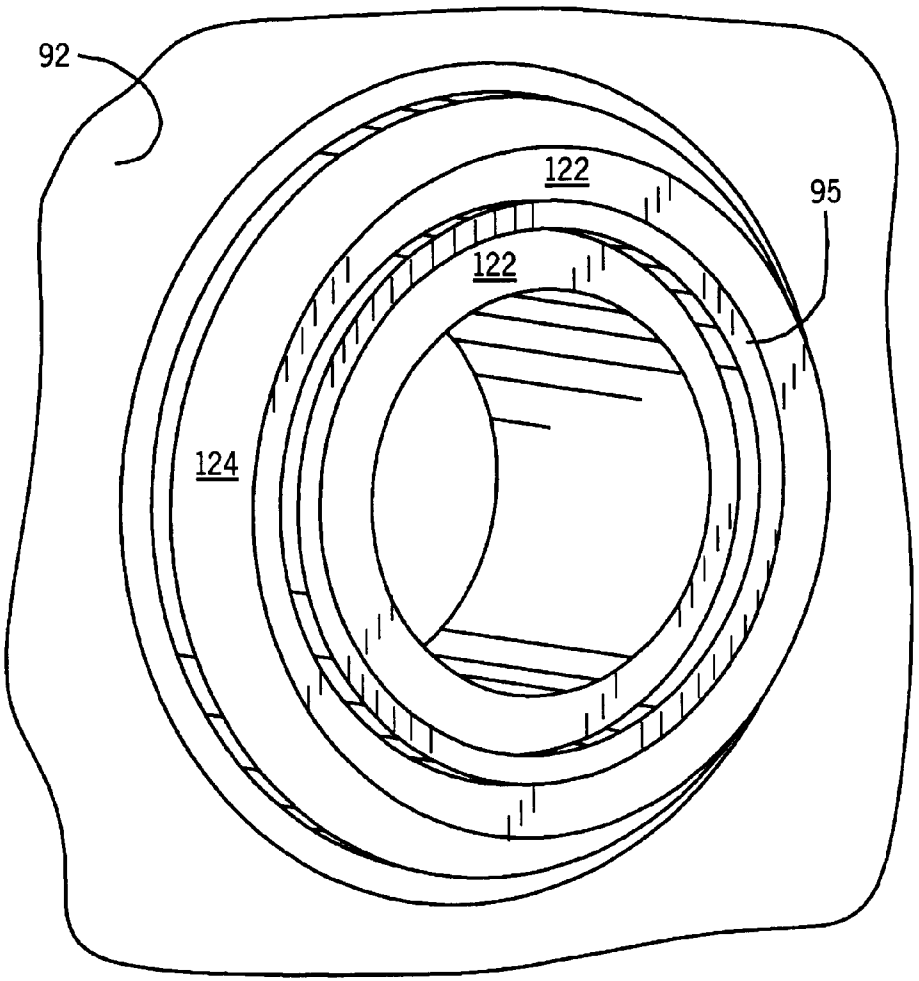
FIG. 11 is a perspective view of a crush zone of the fan segment of FIG. 6.

Referring now to FIG. 11, a partial view of the base 92 of a fan blade segment 78 including an annular crush zone 95 is shown. The crush zone 95 extends above a pair of generally planar surfaces 122, and can be crushed toward the planar surfaces upon assembly of the fan blade to the hub and plate. A raised collar 124 includes the planar surfaces 122 and provides support for the crush zone 95 during fan assembly.

Figure 12:
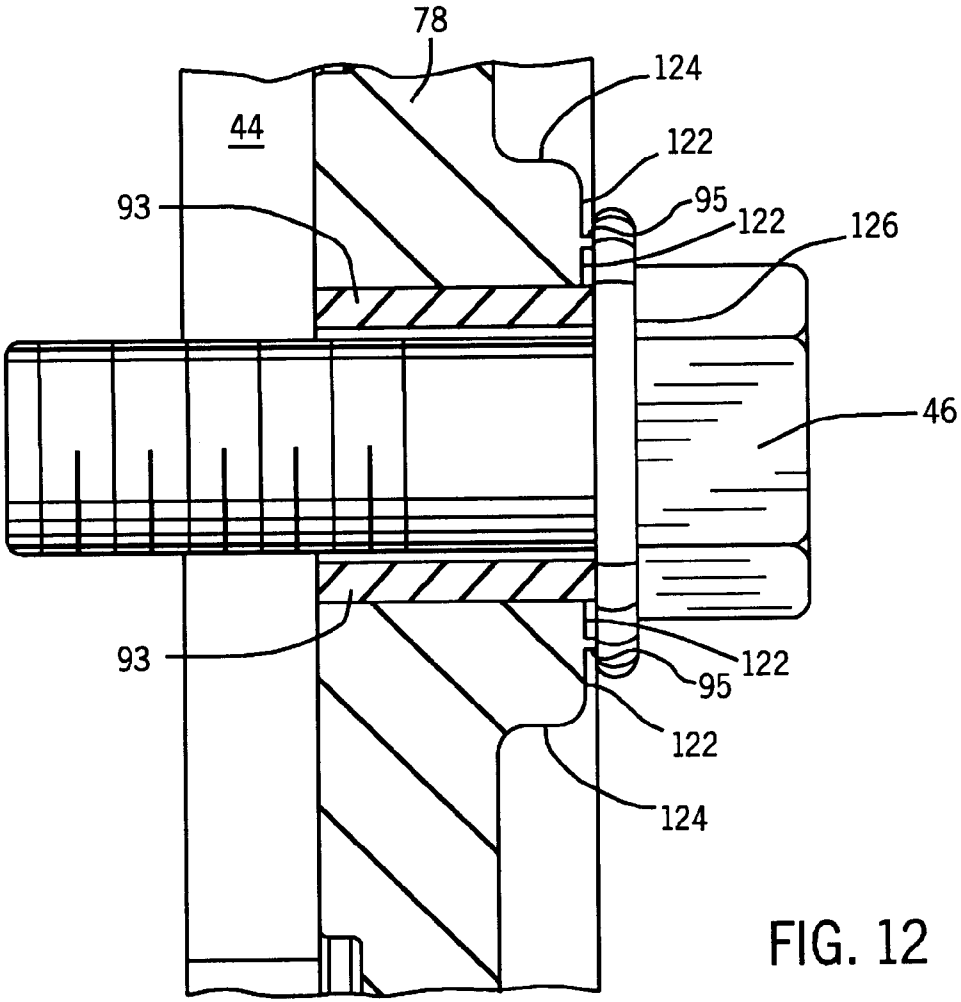
FIG. 12 is a partial cross-section view of a crush zone of the fan segment of FIG. 6 having a fan blade bolt threaded therethrough.

FIG. 12 provides a partial cross-sectional view of a fan blade screw 46 connecting the fan blade segment 78 to the plate 44. As fan blade screw 46 crushes the annular crush zones 95, metal sleeves 93 limit the crushing of the crush zones 95 to prevent the head 126 of the fan blade screw 46 from contacting the planar surfaces 122 of the raised collar 124.

Figure 13:
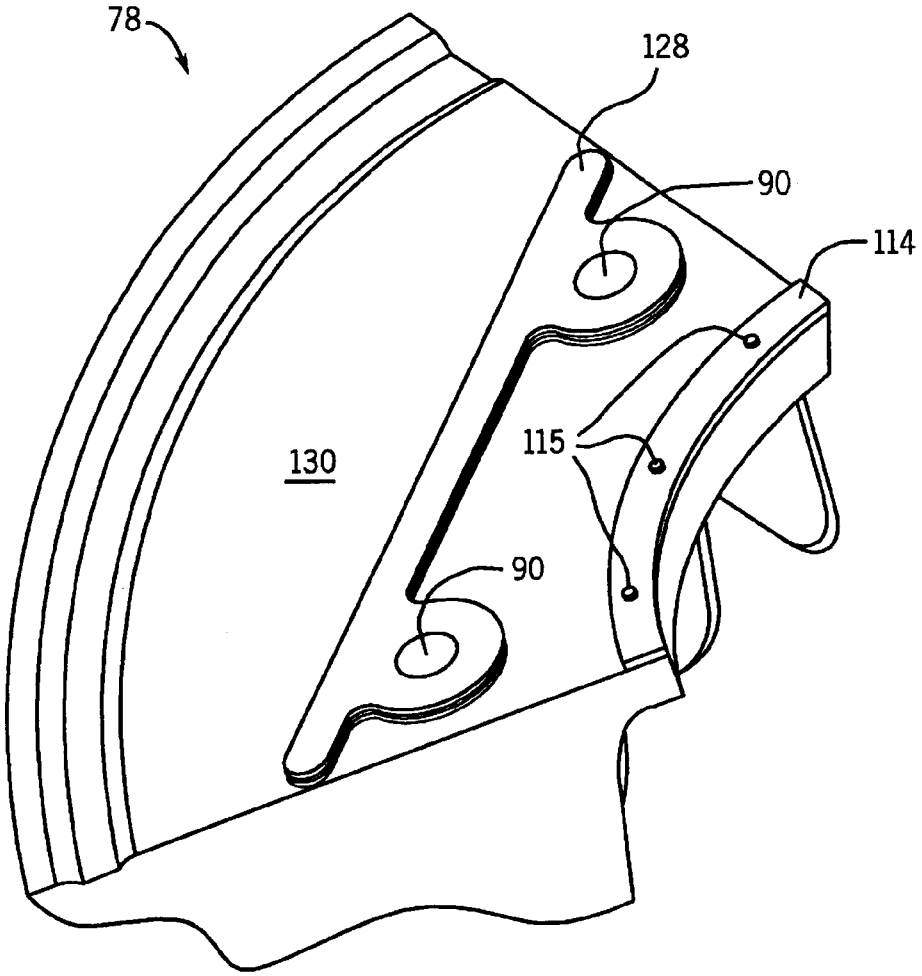
FIG. 13 is an underside view of the fan segment of FIG. 6.

An underside view of the fan blade segment 78 is shown in FIG. 13. A second contact pad 128 surrounds apertures 90 and is configured to combine with contact pad 114 to prevent the plate from contacting an underside surface 130 of the fan blade segment during fan assembly. Preferably, contact pad 114 includes three crush zones 115 that assist with preventing looseness of the fan blades. In alternative embodiments, each fan blade segment 78 may have more or less than three crush zones 115 connected to the contact pad 114.

In accordance with an aspect of the present invention, a fan comprises a fan blade assembly having an inner arcuate end. The fan includes a hub having an inner annular lip and an outer annular lip, with the outer annular lip adapted to receive the inner arcuate end of the fan blade assembly. The fan blade assembly may include a plurality of fan blade segments, each mounted to a flexible plate with a gap therebetween. The flexible plate has an aperture therethrough to receive the inner annular lip therein, and is attached to the hub and fan blade assembly. The plate is configured to provide flexibility to the fan blade assembly.

In accordance with another aspect of the present invention, a system for cooling an engine driven welding machine generator includes a rotary shaft having a first end rotatably attached to a generator housing and being rotated by transmission of a driving force applied thereto by a flywheel. The system has a hub fastened to a second end of the rotary shaft and at least two fan blade segments configured to engage an outer annular lip of the hub. The system further includes a plate affixed to the flywheel and having the at least two fan blade segments mounted thereto. The plate has an aperture to receive an inner annular protrusion of the hub therein.

In accordance with the process of the present invention, a method to stabilize a fan for cooling an engine driven welding machine generator includes the steps of positioning a number of fins to at least one fan segment such that adjacent fins have unequal spacing therebetween and connecting the at least one fan segment between a hub and a plate. Alternatively, the method may also include the step of segmenting at least one fan segment into a plurality of fan segments and concentrically positioning the fan segments around the hub with a given spacing therebetween.

The present invention has been described in terms of the preferred embodiment, and it is recognized that equivalents, alternatives, and modifications, aside from those expressly stated, are possible and within the scope of the appending claims.

What is claimed is:

1. A fan comprising:

a fan blade assembly having an inner arcuate end;

a hub having an inner annular lip and an outer annular lip, the outer annular lip adapted to receive the inner arcuate end of the fan blade assembly; and a flexible plate having an aperture therethrough to receive the inner annular lip therein, the plate attached to the hub and fan blade assembly and configured to tolerate flexation to the fan blade assembly.

2. The fan of claim 1 wherein the fan blade assembly includes a plurality of fan blade segments.

3. The fan of claim 2 wherein each fan blade segment has a plurality of fins and wherein contiguous fins of a fan blade segment define an arc distance therebetween such that at least two of the arc distances for one fan blade segment are unequal with respect to one another.

4. The fan of claim 2 wherein each fan blade segment has at least one crush zone on a side opposite that having a plurality of fins thereon.

5. The fan of claim 4 wherein the at least one crush zone is compressible when the respective fan blade assembly is mounted to the flexible plate.

6. The fan of claim 2 wherein each of the fan blade segments has at least one metal sleeve with a corresponding crush zone having an aperture therethrough, the crush zone including an elastomer material adjacent to the metal sleeve.

7. The fan of claim 1 wherein the fan blade assembly has a plurality of fins integrally molded to the base and having unequal spacing from one to another.

8. The fan of claim 1 wherein the fan blade assembly is comprised of an elastomer material.

9. The fan of claim 1 wherein the fan blade assembly includes four fan blade segments, each mounted to the flexible plate with a gap therebetween.

10. The fan of claim 1 wherein the fan blade assembly includes a plurality of fins, each having a tapered end forming a reduced inner diameter to accommodate the hub therein.

11. A system for cooling an engine driven welding machine generator comprising:

a rotary shaft having a first end rotatably mounted to a generator housing and a second end, the second end of the rotary shaft rotated by transmission of a driving force applied thereto by a flywheel;

a hub fastened to the second end of the rotary shaft;

at least two fan blade segments configured to engage an outer annular lip of the hub; and a plate affixed to the flywheel and having the at least two fan blade segments mounted thereto, the plate having an aperture to receive an inner annular protrusion of the hub therein.

12. The system of claim 11 wherein each fan blade segment has a plurality of fins separated by respective arc distances such that at least two of the respective arc distances are unequal.

13. The system of claim 12 wherein the at least two fan blade segments and the plurality of fins are integrally molded and formed of an elastomer material.

14. The system of claim 11 wherein the at least two fan blade segments have one or more compressible crush zones on a base of the fan blade segments and one or more metal sleeves adjacent each crush zone and defining an aperture therethrough, the crush zone configured to compress during mounting of the plate to the at least two fan blade segments.

15. The system of claim 14 wherein the crush zone is constructed of an elastomer material.

16. The system of claim 11 wherein each of the at least two fan blade segments are concentrically located about the hub.

17. A method to stabilize a fan for cooling an engine driven welding machine generator, the method comprising the steps of:

positioning a number of fins about at least one non-metallic fan segment such that adjacent fins have unequal spacing therebetween;

providing mounting apertures having metallic inserts in the non-metallic fan segment; and connecting the at least one fan segment between a hub and a plate.

18. The method of claim 17 further including the steps of segmenting the at least one fan segment into a plurality of fan segments and concentrically positioning the plurality of fan segments around the hub with a given spacing therebetween.

19. The method of claim 18 wherein the plurality of fan segments are molded of an elastomer material.

20. The method of claim 17 further comprising positioning the fins of the at least one fan segment such that an inconsistent distance between fins results for at least three consecutive fins of at least one fan segment.

21. The method of claim 17 further including the step of integrally molding the fins and the at least one fan segment.

22. The method of claim 17 further including the step of essentially radially aligning the fins from a center of the hub.

23. The method of claim 17 further including the step of aligning each of the fins of the at least one fan segment at a common angle with respect to a base of the at least one fan segment.

24. The method of claim 17 wherein the plate has an aperture therethrough defining an inner edge of the plate and further including the step of abutting an annular lip of the hub to the inner edge of the plate.

25. The method of claim 17 further including the step of abutting an inner arcuate end of the at least one fan segment to the hub.

26. The method of claim 17 further including the step of providing a crush zone cushion in the non-metallic at least one fan segment.

* * * * *